US005372358A

United States Patent [19]

Vauthier

[11] Patent Number: 5,372,358

[45] Date of Patent: Dec. 13, 1994

[54] INTRODUCTION FRONT STOP FOR A DEVICE FEEDING BOX BLANKS

[75] Inventor: Charles Vauthier, Bremblens, Switzerland

[73] Assignee: Bobst SA, Lausanne, Switzerland

[21] Appl. No.: 979,224

[22] Filed: Nov. 20, 1992

[30] Foreign Application Priority Data

Nov. 21, 1991 [CH] Switzerland ..... 03413/91-0

[51] Int. Cl.[5] ..... B65H 5/08

[52] U.S. Cl. ..... 271/12; 271/97; 271/35; 271/165

[58] Field of Search ..... 271/3.1, 35, 97, 98, 271/165, 166, 11, 12, 90, 104

[56] References Cited

U.S. PATENT DOCUMENTS

| | | | |
|---|---|---|---|
| 2,639,916 | 5/1953 | Anness | 271/35 |
| 2,806,696 | 9/1957 | Bishop | 271/98 |
| 3,655,181 | 4/1972 | Paulson | 271/165 X |
| 3,664,660 | 5/1972 | Runzi | 271/35 |
| 3,907,278 | 9/1975 | Jaton . | |
| 3,934,869 | 1/1976 | Strobel, Jr. | 271/166 X |
| 4,463,942 | 8/1984 | Newsome | 271/98 |
| 5,088,711 | 2/1992 | Newsome | 271/3.1 X |
| 5,222,720 | 6/1993 | Newsome | 271/166 X |

FOREIGN PATENT DOCUMENTS

| | | | |
|---|---|---|---|
| 75936 | 3/1992 | Japan | 271/98 |

*Primary Examiner*—Robert P. Olszewski
*Assistant Examiner*—Boris Milef
*Attorney, Agent, or Firm*—Hill, Steadman & Simpson

[57] ABSTRACT

A front stop for a feeding device has a planar lower surface connected to a round part and is provided with a bore, which is connected to a fluid source and has channels extending to the planar flat surface to enable a flow of fluid between a blank being fed under the stop and the next following blank of a pile of blanks in the feeder. This flow of air creates a cushion which reduces damage to the surfaces of the blanks, such as printed surfaces.

2 Claims, 2 Drawing Sheets

INTRODUCTION FRONT STOP FOR A DEVICE FEEDING BOX BLANKS

BACKGROUND OF THE INVENTION

The present invention is directed to an improvement for an introduction front stop or gauge to be used in a device designed to feed box blanks to a folding arrangement to produce folded box blanks. The front stop or gauge of the device comprises a vertical stop body, whose lower part is rounded and serves as a support for the leading edge of each of the box blanks which are to be introduced and processed.

The devices, which are known up to now and are designed for feeding box blanks to a folding device, are ordinarily called feeders and usually comprise a lower carrying member consisting of a series of endless belts arranged side-by-side across the width of the device. These endless belts are driven by a driving roller, which is located at the outlet of the feeder adjacent an inlet of the processing device, and the belts travel around an idler roller located at the opposite end of the device. The upper run of each of the endless belts is supported furthermore by a series of supporting rollers, which are also free to rotate, so as to make up a carrying plane with a rather rigid surface. A vertical front stop is arranged almost on the axis and above the driven roller. The box blanks, which are to be fed from the device or feeder, are arranged in a stack in a slanting manner on top of the endless belts, with the blanks' front edge resting against the rounded part of the front stop and the rear edge of the lowermost blank of the stack being rested on one or more supports.

In the preferred arrangement, two front stops are arranged side-by-side across the width of the feeder. In order to allow the infeed of the blank, the front stop is mounted above the belts with a clearance between the lower part of the front stop and the endless belt, which clearance corresponds almost to the thickness of the blank. The box blanks are usually printed and, for folding requirements, are placed in the feeder so as to have their printed surfaces facing the endless belts. When being fed in, the lowermost blank of the pile of blanks positioned in the feeder will necessarily rub its unprinted upper surface against the printed surface of the next following blank of the pile.

Another example of a device for feeding blanks is disclosed in U.S. Pat. No. 3,907,278, whose disclosure is incorporated herein by reference thereto.

By this conception, the feeders known up to now have certain drawbacks when feeding in blanks with printed surfaces which are very sensitive to scratches, as well as to wear and tear. As a matter of fact, the use of a conventional front stop cannot prevent the permanent existence of a certain pressure, which is caused by the weight of the blank pile positioned in the feeder between the lowermost blank of the pile and the following blank. This pressure produces a negative effect when feeding blanks which have a very delicate printing, for example, when processing blanks printed with inks which are polymerized by ultra-violet rays or with inks of similar resistance characteristics. With a conventional front stop, the blank print is damaged to such an extent that the folding box blanks, when processed, have to be disposed of or discarded.

SUMMARY OF THE INVENTION

The present invention is directed to providing a remedy to prevent the damaging of the printed surfaces of box blanks while being fed through a blank feeder.

To accomplish these objects, the present invention is directed to an improvement in an introduction front stop to be used in a device designed to feed box blanks into a processing device, said front stop comprising a vertical front stop body of a rectangular shape, whose lower part is rounded and serves as a support for engaging leading edges of a pile of box blanks to be fed into the processing machine, the improvements comprise the lower part of the front stop having a surface connected to the rounded part, which rounded part serves as a support for the blanks, said lower part being equipped with means making a flow of fluid between the blank in the course of being fed out of the feeder and the next following blank of the pile of blanks to be fed into the machine for processing the blanks.

The advantages provided by this improvement consist essentially in the suppression of damage caused to the print of the blank, as well as an almost zero rate of blank rejection or waste. Hence, an increase in the productivity features are provided for the blank processing machine.

A realization mode of the introduction front stop, according to the present invention, will be readily apparent from the following description of the preferred embodiments, the drawings and claims.

DESCRIPTION OF THE PREFERRED EMBODIMENTS

Figure 1:
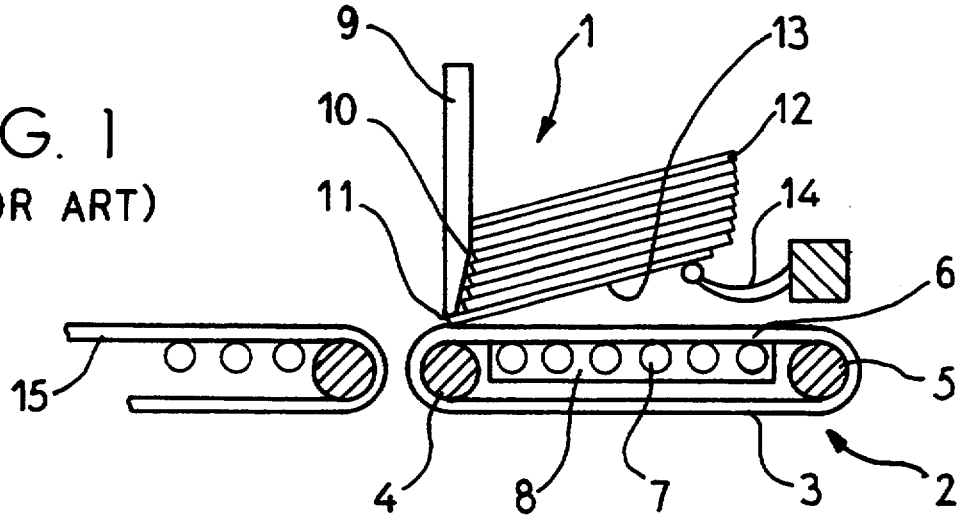
FIG. 1 (PRIOR ART)
FIG. 1 is a schematic view of a prior art feeding device which can utilize the improvement of the present invention.

The principles of the present invention are particularly useful when incorporated in a feeding device, generally indicated at 1 in FIG. 1. The feeding device 1 includes a feeder, generally indicated at 2, which, itself, is composed of a series of endless belts 3, which are arranged side-by-side across the width of the feeder 2. The endless belts 3 are driven by a driving roller 4, which is located at the outlet of the feeder which is adjacent an inlet for a carrying member 15 of the processing machine or device, which may be a folder-gluer. The belts 3 also pass around a roller 5, which is free to rotate, adjacent an opposite end of the feeder. An upper run 6 of each of the endless belts 3 is held up by supporting rollers 7 which are arranged on a longitudinally extending beam located under each of the endless belts 3. A front stop 9 comprises a lower part 10 with a rounded shape, and the front stop is arranged on the axis of one of the rollers, such as the driven roller 4 or one of the support rollers 7, and above the endless belt 3. The front stop 9 is positioned to form a gap or clearance 11, which corresponds to the thickness of the blank 12 that is kept between the rounded part 10 of the front stop 9 in order to allow the passage of the blank 13. The blanks 12 and 13, respectively, are arranged in a slanted pile within the feeder and on top of the endless belts 3. The front edges of the blanks rest against the rounded lower part 10 of the front stop and the rear edge of the lower blank 13 of the pile, rest on supports 14. The feeder 2 is located upstream with regard to the conveyor 15 of the blank processing machine, which may be a folding a gluing machine.

Figure 2:
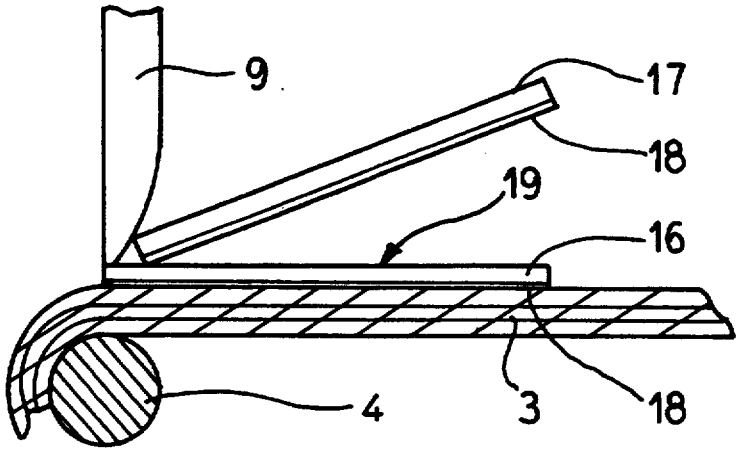
FIG. 2 (PRIOR ART)
FIG. 2 is a schematic view of the front stop of the prior art feeder.

As illustrated in FIG. 2, the prior art devices up to now, which would feed blanks, such as 16 and 17, which have a print 18 on their lower surfaces and face the belts 3. The blank 16 is represented here and is being fed into the machine. Owing to the drive effect of the endless belts 3, the blank 16 will pass under the front stop 9 and rub its unprinted upper surface 19 against the printed surface 18 of the next following blank 17 of the pile of blanks during the whole feeding operation.

Figure 3:
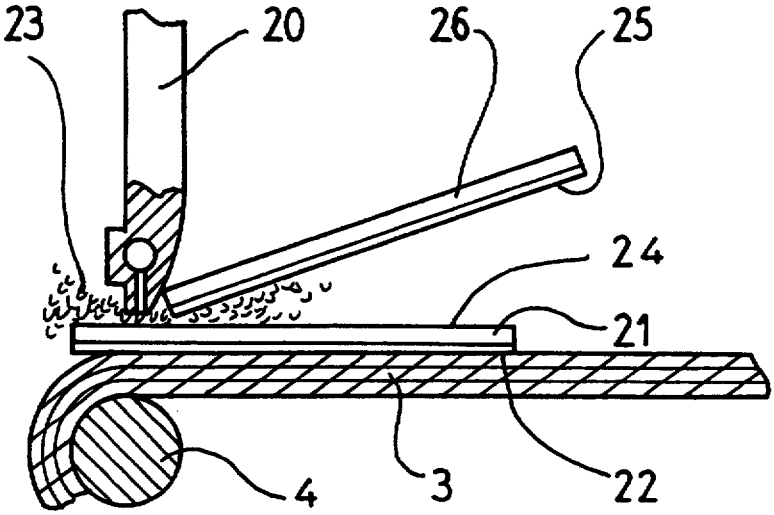
FIG. 3 is a schematic view with portions broken away for purposes of illustration of a front stop in accordance with the present invention.
Figure 4:
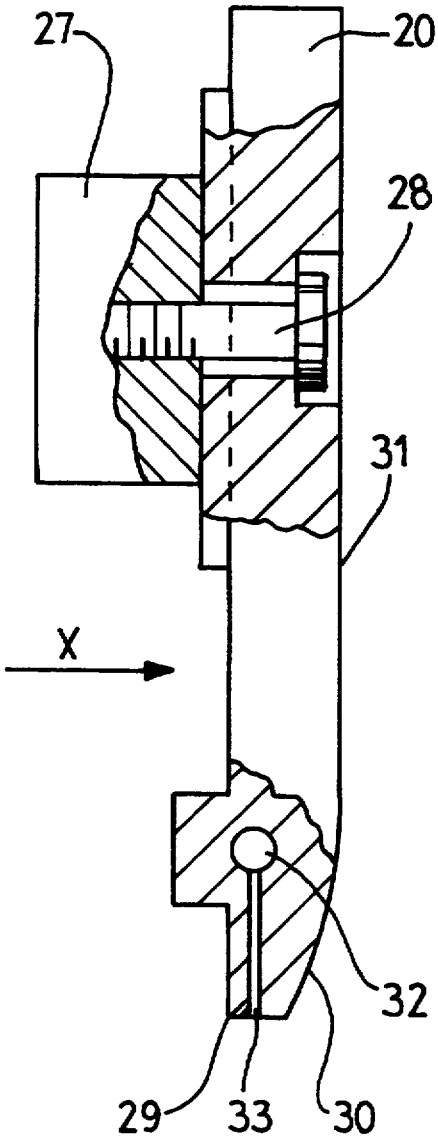
FIG. 4 is an enlarged side view with portions broken away for purposes of illustration of the front stop of FIG. 3.
Figure 5:
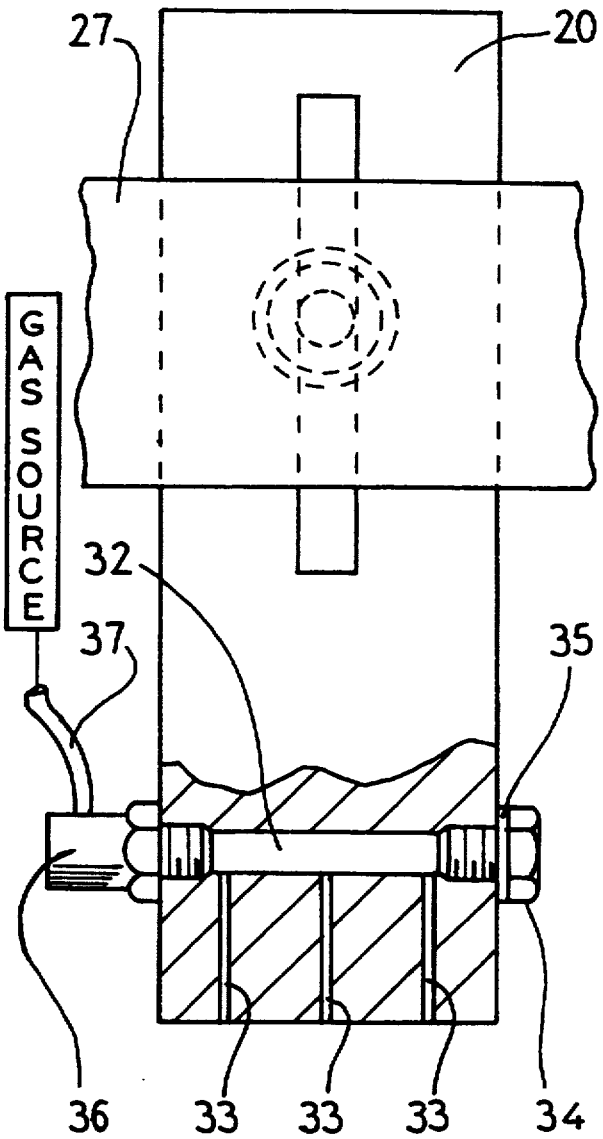
FIG. 5 is a view with portions broken away taken in the direction of the arrow X of FIG. 4.

The improvement of the present invention is the improvement in the structure of the front stop. For this feature, as illustrated in FIG. 3, the front stop 20 of the present invention is arranged in such a way as to permit a fluid cushion 23 to be formed at the end of its lower part. FIGS. 4 and 5 will illustrate the improvement in greater detail. The blank 21, as illustrated in FIG. 3, is carried under the front stop 20 by the endless belts 3 with no rubbing of its printed surface 22 on the belts. A fluid, such as compressed air, is supplied from a source, such as a gas source of FIG. 5, and is permanently blown on the unprinted upper surface 24 (FIG. 3) of the blank 21 through a lower part of the front stop 20. At the level of the lower part of the front stop, this flow of fluid forms a fluid cushion 23 which has, between other advantages, the elimination of any frictional rubbing effects between the unprinted surface 24 of the lower blank 21 and the printed surface 25 of the next following blank 26 of the pile. This cushion 23 will prevent the abrasion between the two blanks 21 and 26. In certain cases, for instance when processing small-size blanks, which are piled in small amounts and when using a high fluid pressure, the fluid flow or cushion could even cause a complete loss of contact between the two blanks 21 and 26.

The front stop 20, as illustrated in FIG. 4, has a rectangular cross section and is constructed so that it can be vertically adjusted on a crossbar 27, which extends between the two lateral frame members (not illustrated) of the feeder 2 by means of a special screw, such as 28. The lower part of the front stop 20 has a planar flat surface 29, as well as a rounded or curved surface 30 which extends from the planar surface 29 up to a contact surface 31 of the stop. The lower part of the front stop 20 has a bore 32 which is drilled through the width of the front stop 20. Fluid-supplying channels 33, which amount to three in the present realization, connect the bore 32 to the atmosphere and open on the planar surface 29. In its preferred construction, these fluid-supplying channels 33 extend perpendicular to the plane defined by the planar surface 29.

As illustrated in FIG. 5, the bore 32 is closed on one of its ends by a screw 34 provided with a seal 35. The other end is equipped with a threaded union 36 connected to a fluid-supplying pipe 37, which will extend to the gas source. As illustrated, three channels 33 are arranged in the lower part of the front stop 20.

It should be understood that the use of larger or smaller numbers of channels 33 could be contemplated according to the blank print characteristics or the weight of the blanks.

Although various minor modifications may be suggested by those versed in the art, it should be understood that I wish to embody within the scope of the patent granted hereon all such modifications as reasonably and properly come within the scope of my contribution to the art.

I claim:

1. A device for feeding box blanks one at a time from a bottom of a stack of blanks to a processing machine, said device comprising conveyor means having a conveyor belt moving in a plane, a vertical front stop body of a rectangular shape being positioned over the conveyor belt for defining a front edge of the stack, a rear support means for supporting a rear edge of a bottom blank of the stack, said stop body having a lower part provided with a rounded surface for supporting leading edges of the box blanks adjacent the bottom blank of the stack, said stop body having a lower flat planar surface merging with the rounded surface and facing an upper surface of the conveyor belt to define a slot for passing a single blank, said stop body having at least one channel extending substantially perpendicular to said planar surface and means for creating a flow of fluid from the channel along the planar surface to create a flow between a blank being fed under the planar surface and the next following blank of the pile of blanks to be fed into the processing machine.

2. A device according to claim 1, wherein the stop body has three channels extending perpendicular to the planar surface from a transverse channel extending substantially parallel to the planar surface.

* * * * *